United States Patent [19]

Hayakawa et al.

[11] Patent Number: 4,992,348

[45] Date of Patent: Feb. 12, 1991

[54] ELECTROPHOTOGRAPHIC PHOTOSENSITIVE MEMBER COMPRISING AMORPHOUS SILICON

[75] Inventors: Takashi Hayakawa, Nara; Shiro Narikawa, Kashihara; Kunio Ohashi, Nara, all of Japan

[73] Assignee: Sharp Kabushiki Kaisha, Osaka, Japan

[21] Appl. No.: 372,019

[22] Filed: Jun. 27, 1989

[30] Foreign Application Priority Data

Jun. 28, 1988 [JP] Japan ..... 63-161977
Nov. 29, 1988 [JP] Japan ..... 63-303324

[51] Int. Cl.[5] ..... G03G 5/14; G03G 5/082

[52] U.S. Cl. ..... 430/57; 430/85; 430/86; 430/95

[58] Field of Search ..... 430/57, 85, 86

[56] References Cited

U.S. PATENT DOCUMENTS 4,265,991 5/1981 Hirai et al. ..... 430/64
4,405,702 9/1983 Shirai et al. ..... 430/60
4,471,042 9/1984 Komatsu et al. ..... 430/64
4,532,199 7/1985 Ueno et al. ..... 430/128
4,760,008 7/1988 Yamazaki et al. ..... 430/127
7,505,732 11/1987 Saitoh ..... 430/57

FOREIGN PATENT DOCUMENTS 60-35059 8/1985 Japan .

OTHER PUBLICATIONS

Brodsky, M. H., et al., Entitled "Quantitative Analysis of Hydrogen in Glow Discharge Amorphous Silicon" Applied Physics Letters, vol. 30, No. 11, Jun. 1977, pp. 561-563.

*Primary Examiner*—David Welsh
*Attorney, Agent, or Firm*—Sandler, Greenblum & Bernstein

[57] ABSTRACT

A photosensitive member for electrophotography which comprises a conductive substrate and a photoconductive layer which is composed of an amorphous silicon layer and an amorphous silicon germanium layer containing a specific amount of hydrogen and/or halogen respectively, and being prepared by electron cyclotron resonance method respectively, which is useful for xerographic systems.

14 Claims, 13 Drawing Sheets

(A)

(B)

(C)

(A)

(B)

(C)

(A)

(B)

(C)

ELECTROPHOTOGRAPHIC PHOTOSENSITIVE MEMBER COMPRISING AMORPHOUS SILICON

BACKGROUND OF THE INVENTION

1. Field of the Invention

The invention relates to a photosensitive member for electrophotography used for image formation apparatus in an electrophotographic technology, and more particularly to a photosensitive member for a laser printer comprising a semiconductor laser as a light source.

2. Description of the Prior Art

Recent image formation apparatus in an electrophotographic technology employs a semiconductor laser as a light source, wherein a shortest wave length is 780~830 nm for a stable high output in the practically used semiconductor laser. In the meantime, a photosensitive member used in a conventional image formation apparatus or a photosensitive member employing an amorphous silicon not including Ge as photoconductive layer (called hereinafter a-Si) are lower in sensitivity in the range of longer wavelength, so that it is expected to practically use such a photosensitive member employing an amorphous silicon having Ge as photoconductive layer (called hereinafter a-SiGe) with a higher sensitivity in the longer wavelength range.

a-SiGe has such advantages as (1) longer life, (2) harmless to men and (3) highly sensitive to a longer wavelength.

Conventionally, a photoconductive layer of a-Si or a-SiGe is made by the plasma CVD method, the sputtering method or the like. A total content of hydrogen and/or halogen (to be applied corresponding to any material gas) in the photoconductive layer that is utilized as photosensitive member for electrophotography and formed through the above-mentioned methods is limited as having 10–40 atomic % (U.S. Pat. No. 4,265,991).

Also, when the above-mentioned methods are used to make a total content of hydrogen and/or halogen to 40 atomic % or more by lowering the temperature of a substrate, the resulting photoconductive layer is considerably lower in photosensitivity, and hence cannot be put into practical use for an electrophotographic photosensitive member.

It is expected that the photosensitive member with the conventional a-SiGe photoconductive layer (called hereinafter a-SiGe photosensitive member) could get a higher sensitivity in the longer wavelength range by making smaller an optical band gap in comparison with that of using a-Si not containing Ge, but it has in practice an insufficient photosensitivity, and is smaller in dark resistivity to thereby be notably poor in charge acceptance and dark decay characteristic, so that it is still not enough to be used as a photosensitive member using Carlson process. This may be caused by the fact that a total content of hydrogen and/or halogen in the photoconductive layer is smaller, so that hydrogen and/or halogen are not sufficiently coupled with Ge atom, and hence dangling bonds of the Ge atom itself are is increased. Also, in the case of lowering the temperature of the substrate in the conventional methods in order to increase hydrogen and/or halogen content as mentioned above, the reason why photosensitivity is not sufficient is to be due to the formation of a chain bond of $(SiH_2)n$.

Under such problems, the present invention intends to provide an electrophotographic photosensitive member which has an improved electric property of photoconductive layer comprising a-SiGe.

In the meantime, it has been proposed to deposit an amorphous silicon film by electron cyclotron resonance method (called hereinafter ECR method). (See U.S. Pat. No. 4,532,199).

SUMMARY OF THE INVENTION

The present invention provides a photosensitive member for electrophotography comprising a conductive substrate and a photoconductive layer in which the photoconductive layer employs an amorphous silicon layer deposited by means of ECR method and containing hydrogen and/or halogen at 40–65 atomic % and an amorphous silicon germanium layer deposited by means of ECR method and containing hydrogen and/or halogen at 40–65 atomic %.

Also, the present invention provides a manufacturing method for the above-mentioned photosensitive member for electrophotography.

The electrophotographic photosensitive member according to the invention is superior in electric properties such as charge acceptance and dark decay characteristic, photosensitivity and the like. Also, the manufacturing method can provide the photosensitive member for electrophotography with good yield and cheapness.

PREFERRED EMBODIMENT OF THE INVENTION

Figure 1:
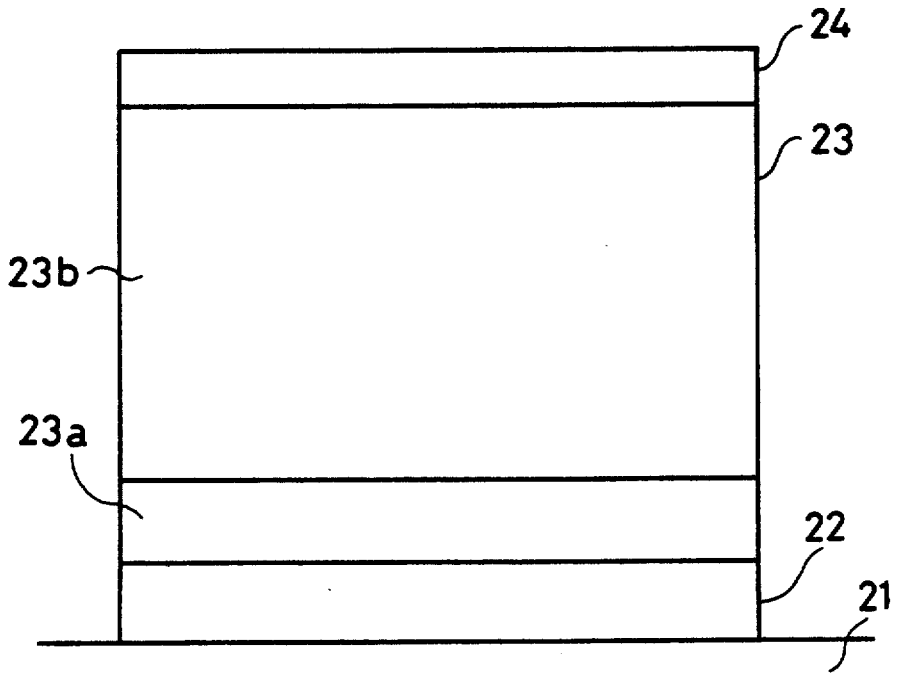
FIG. 1 is an explanatory view showing a sectional construction of a photosensitive member of the present invention.

The electrophotographic photosensitive member of the invention is basically composed by a conductive substrate and a photoconductive layer, but may have an intermediate layer which can prevent the carrier injection from the conductive substrate therebetween and a surface-protecting layer which can protect the photoconductive layer from the electron and chemical attack of the corona charge on a free surface of the photoconductive layer.

The conductive substrate may employ conventional materials available in the art, for example, metals such as Al, Cr, Mo, Au, Ir, Nb, Ta, Pt, Pd and the like, or a plate made from alloys provided from those metals. Also available are a film or a sheet of synthetic resins such as polyester, polyethylene, celluloseacetate, polypropylene and the like, or a sheet of glass, ceramic and the like, surfaces of those materials being subjected to conductivity process. The substrate may be formed in any shape suitable for the purpose and is not limited to a particular shape.

In the invention, the photoconductive layer is composed of a laminated member including a-SiGe layer and a-Si layer. Since a-Si is larger in dark resistivity than a-SiGe, the presence of a-Si layer allows the applied charge to be held on the surface of photosensitive member. Then, irradiation of laser excites a carrier at the a-SiGe layer, so that when a-SiGe layer is deposited at lower side, the carrier moves through the a-Si layer to cancel charge on the surface of the photosensitive member. When a-SiGe layer is deposited at the upper side, the carrier whose polarity is same as the applied charge moves through the a-Si layer to the substrate. As seen, in the photosensitive member of the invention, the a-SiGe layer functions as a charge generating layer and the a-Si layer functions as charge acceptance layer and charge transporting layer. Also, lamination of a-Si layer and a-SiGe layer may be made on a conductive substrate in the order of a-Si layer and a a-SiGe layer or reversely.

In case that a-Si layer, is provided at the surface side of photosensitive member and a-SiGe layer at the remote side from the surface (the substrate side), the following functions will appear. In detail, at the a-SiGe layer, a carrier is excited by a heater provided at the photosensitive member. Since the carrier is generated near the substrate of the photosensitive member, an electron or positive hole is required to move to the surface of photosensitive member to cancel charge thereon. However, the carrier is hard to move through the a-Si layer having a higher dark resistivity, so that charge on the surface of the photosensitive member is not easily cancelled, thereby preventing deterioration of charge acceptance and dark decay characteristic of the photosensitive member.

From the tests made by the present inventors, it was observed that under such a higher power not reported hitherto as 2.5 kw microwave power by ECR without heating substrate as disclosed in the present invention, optical band gap, dark resistivity ($\rho d$), and photoconductivity ($\eta\mu\tau$) of a-Si and a-SiGe become higher as a total of hydrogen content and halogen content increases, and that these changes occur dramatically at a total of the hydrogen and halogen content of about 40 atomic %.

Also, since a total of hydrogen (H) and halogen (X) content in a-Si layer is set to be more than 40 atomic %, an optical band gap of the a-Si layer is made larger, and the layer's optical absorption with respect to a specific wavelength generated by a semiconductor laser is lowered. Thus, a quantity of light reaching a-SiGe layer beneath the a-Si layer becomes larger, so that the light can be effectively used to thereby improve a photosensitivity of the photosensitive member. Furthermore, by setting a total of hydrogen and halogen contents to be more than 40 atomic %, dark resistivity ($\rho d$) and photoconductivity ($\eta\mu\tau$) are improved as aforesaid. It can be seen also in this point that charge acceptance and dark decay characteristic and photosensitivity can be improved.

Also, when a total amount of hydrogen and halogen content in a-SiGe layer is set to be more than 40 atomic % under such a higher power not reported hitherto as 2.5 kw microwave power by ECR method without heating substrate as disclosed in the present invention, a dark resistivity ($\rho d$) and photoconductivity ($\eta\mu\tau$) of the a-SiGe layer itself can be improved, so that the charge acceptance and dark decay characteristics and photosensitivity of the photosensitive member also can be improved.

In the meantime, in each of a-Si layer and a-SiGe layer, when a total content of hydrogen and halogen exceeds almost 65 atomic %, transportation efficiency of carriers is deteriorated in the a-Si layer, and sensitivity in longer wavelength range is lowered in the a-SiGe layer, resulting in an insufficient feature for photosensitive member for a semiconductor laser. The a-Si and a-SiGe photoconductive layers according to the present invention contain the abovesaid larger amount of hydrogen and/or halogen, as could not achieve sufficient photosensitivity in the photosensitive members prepared by the conventional P-CVD or sputtering method or in those provided by ECR method without selecting the specific values of microwave power and material gas pressure as disclosed in the present invention. This is considered as that a structure or bonding of Si atoms and hydrogen and/or halogen atoms which is physically and chemically different from those formed by the conventional methods and requirements is formed in the photoconductive layer disclosed in the present invention.

Also, when the content of Ge in the a-SiGe photoconductive layer is less than 5.3 atomic % with respect to Si, there appears no effect of the addition of Ge to thereby have a larger optical band gap and a poor sensitivity in a longer wave length range. Furthermore, when the content of Ge is more than 150 atomic % with respect to Si, dark resistivity ($\rho d$) is made lower to deteriorate the charge acceptance and dark decay characteristics.

When the a-SiGe photoconductive layer is adapted to have the content of Ge decrease gradually toward the side of the a-Si layer, it mitigates an electrical and constructional mismatching on the border between the a-Si layer and the a-SiGe layer, whereby trap and the like of charge at the border is reduced so as to make less residual potential at the photosensitive member.

Figure 5:
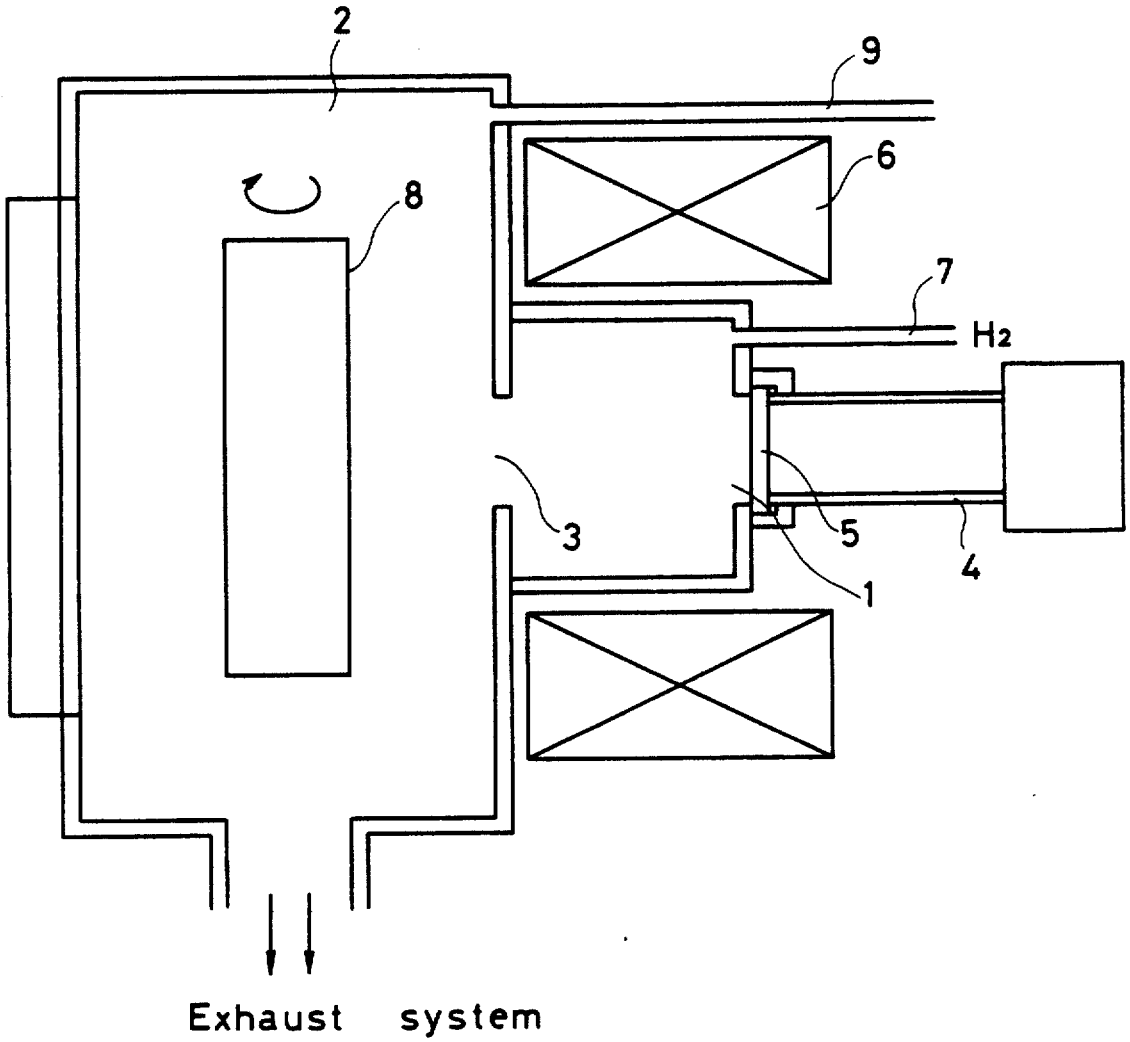
FIG. 5 is an explanatory view showing a structure of a film deposition apparatus using ECR (electron cyclotron resonance) method.

FIG. 5 is a schematic view showing a film deposition apparatus for a-Si layer and a-SiGe layer and the like by ECR method. Deposition of a-SiGe layer, a-Si layer and the like is made on the conductive substrate by the same apparatus.

The apparatus comprises a plasma formation chamber 1 for generating plasma and a specimen chamber 2 for depositing the layers. The plasma formation chamber 1 and the specimen chamber 2 are evacuated to vacuum by an oil diffusion pump and oil rotation pump (each not shown).

The plasma formation chamber 1 comprises a cavity resonator construction wherein a microwave at 2.45 GHz is introduced through a wave guide 4. To be noted is that a microwave introduction window 5 is made from a quartz glass plate through which microwaves can pass. Magnetic coil 6 is disposed around the plasma formation chamber 1 and forms a divergent magnetic field for drawing out plasma generated in the plasma formation chamber 1 into the specimen chamber 2. Specifically, plasma is drawn out through a plasma extracting orifice 3 into the specimen chamber 2.

Almost centrally in the specimen chamber 2 is mounted a substrate 8 for the photosensitive member. The substrate 8 may be made of a conductive material, such as Al and employs a drum-like shaped one in the present embodiment. The drum-like substrate 8 is rotatably supported by a support member (not shown), so that a-SiGe and a-Si are deposited uniformly on the surface of the substrate. The specimen chamber 2 is provided with a material gas introduction line 9 for introducing material gas such as $SiH_4$ and the like into the specimen chamber 2.

Film deposition operation by the apparatus will be detailed. First, the plasma formation chamber 1 and the specimen chamber 2 are evacuated to vacuum, then, material gas is introduced into the specimen chamber 2. Material gas employs Si compound containing hydrogen or halogen such as $SiH_4$, $Si_2H_6$, $SiF_4$, $SiCl_4$, $SiH_2Cl_2$ and the like, and Ge compound containing hydrogen or halogen such as $GeH_4$, $GeF_4$, $GeCl_4$, $GeF_2$, $GeCl_2$ and the like. Gas pressure in this case is set to be about $10^{-3}$–$10^{-4}$ torr, and microwave is introduced into the plasma formation chamber 1 while the magnetic coil 6 is applied to excite plasma. Resultant plasma is directed through the plasma extracting orifice 3 into the specimen chamber 2, so that the material gas is excited to deposit a specific film or layer by the material gas on the substrate 8 uniformly due to the fact that the substrate 8 is rotated in this instance. When the location, opening and the like of the plasma extracting orifice 3 is adjusted, uniformity of deposition for the layer can be improved.

Next, a detailed description will be given first on a-SiGe layer.

Figure 2:
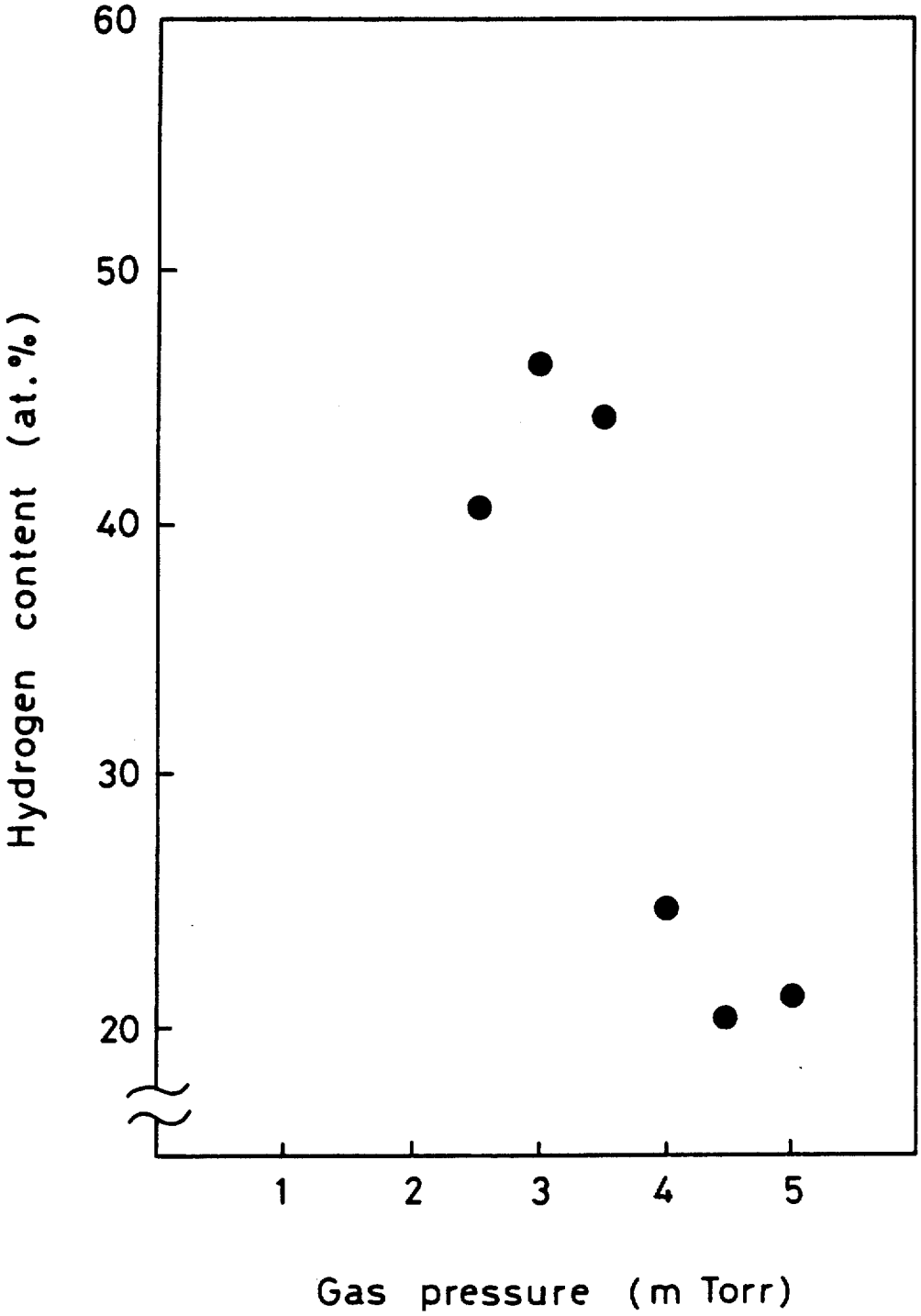
FIG. 2 (A)–(C) and FIG. 4 (A)–(C) are explanatory views showing the relationship between material gas pressure upon the film deposition of a-SiGe photosensitive layer, hydrogen content in the deposited photosensitive layer and dark resistivity or photoconductivity ($\eta\mu\tau$) of the deposited photosensitive layer, respectively.
Figure 2:
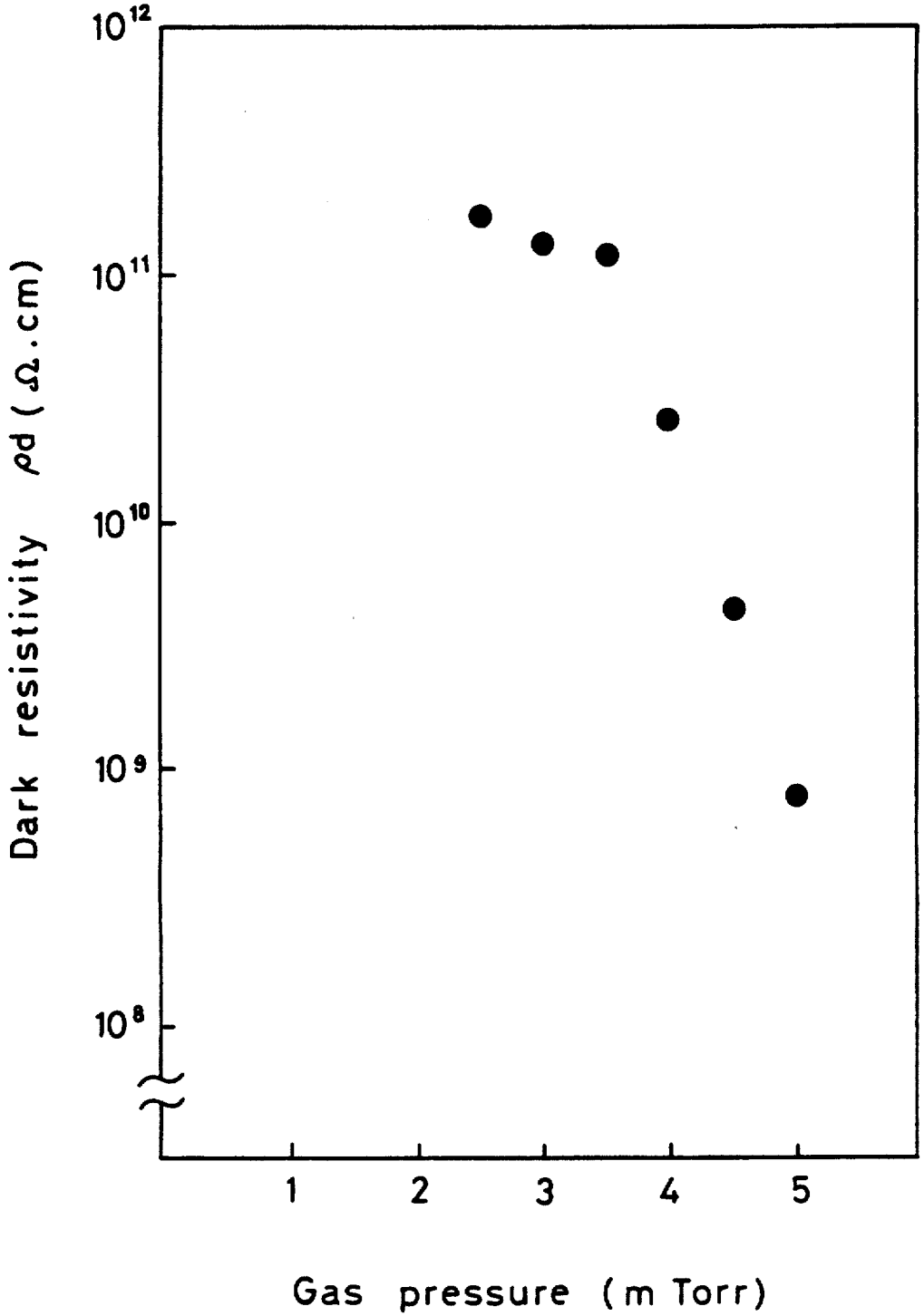
Figure 2:
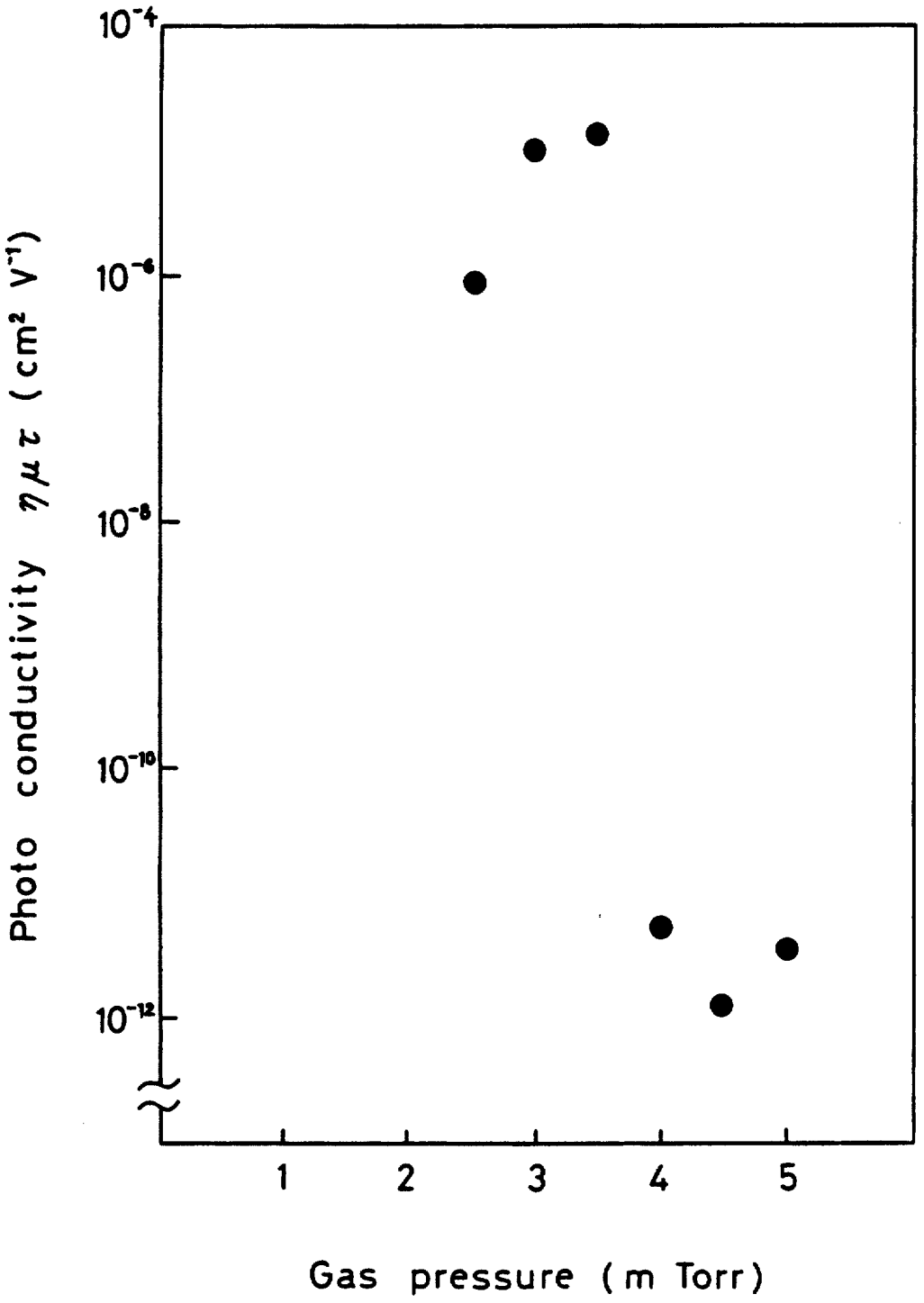
Figure 4:
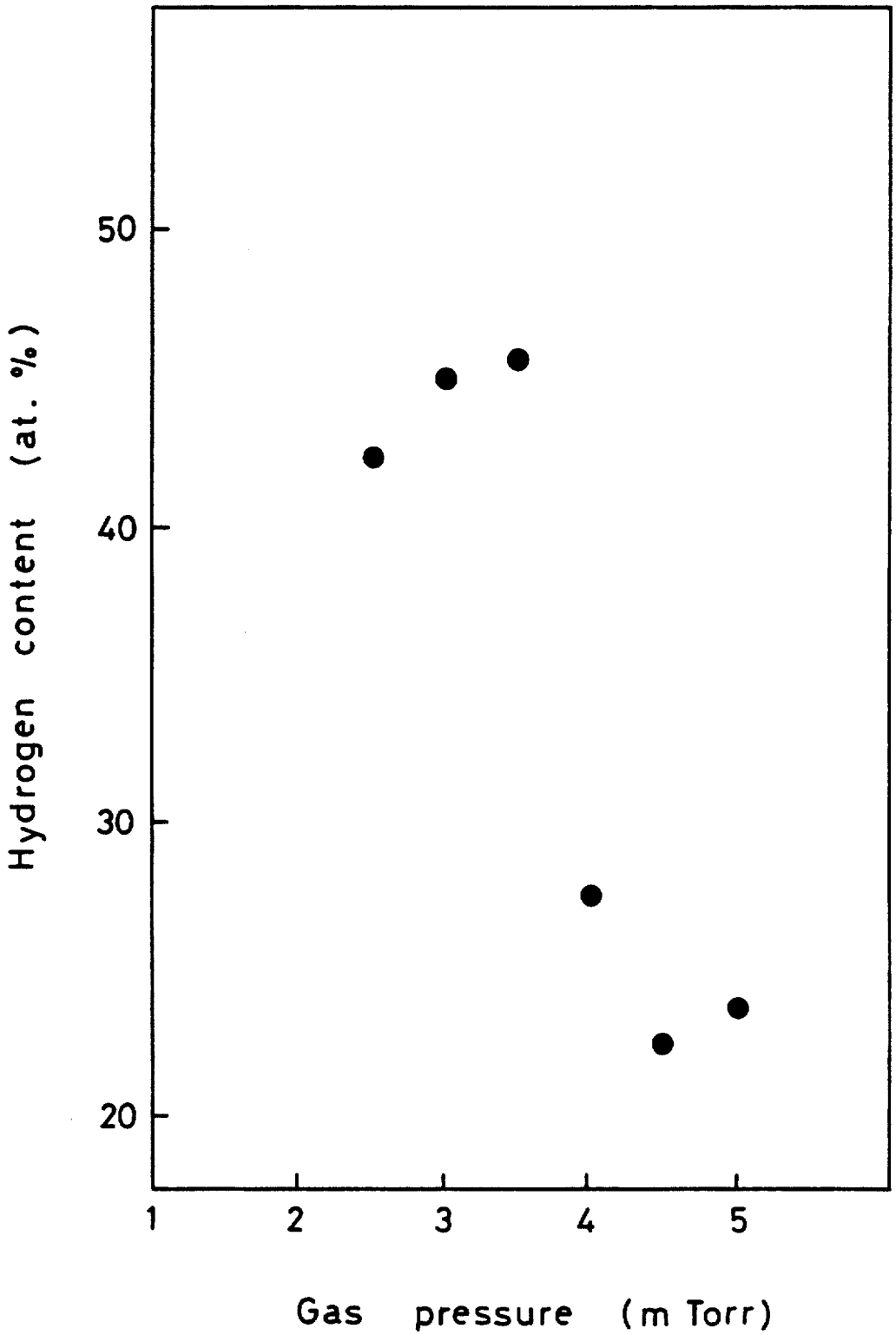
Figure 4:
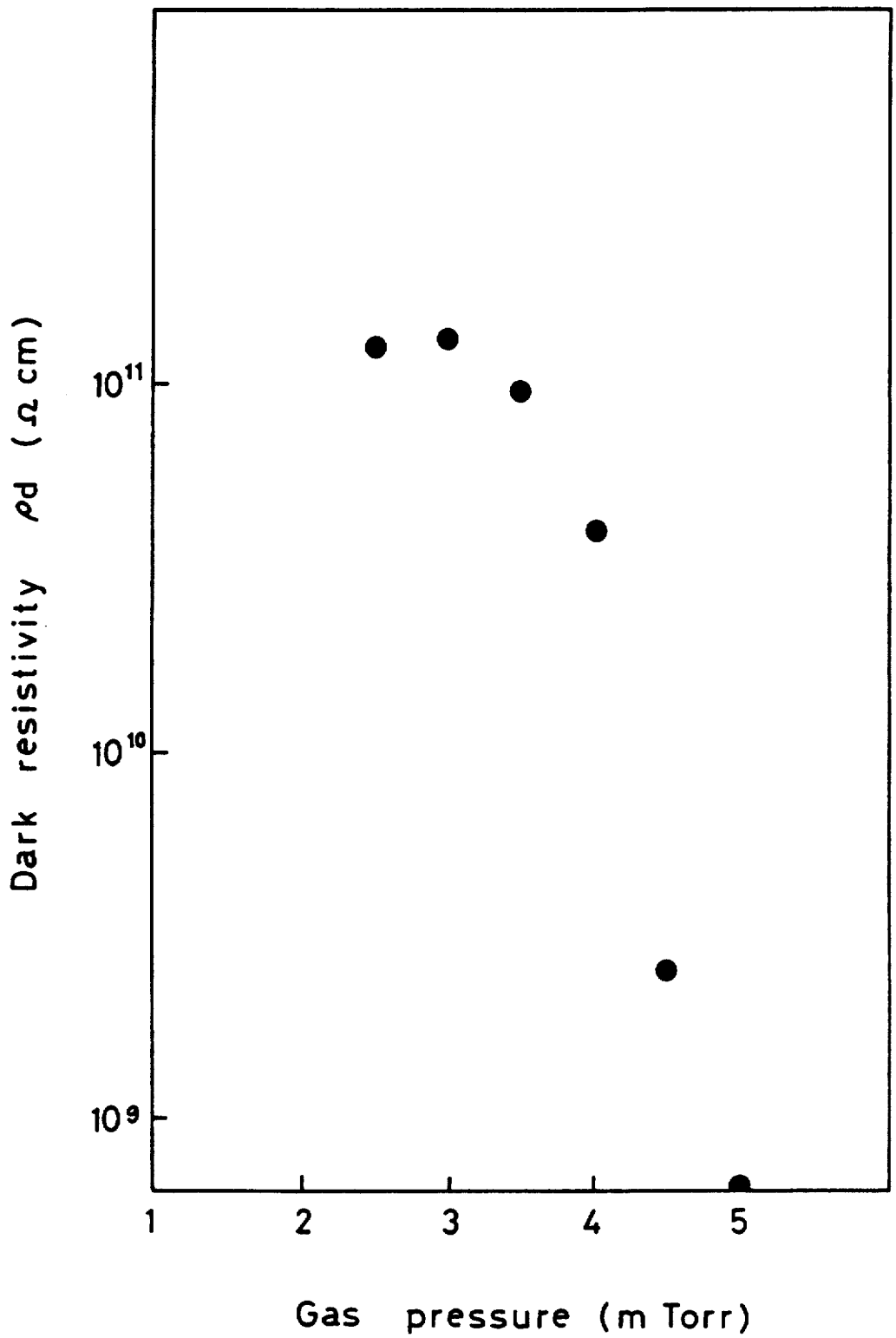
Figure 4:
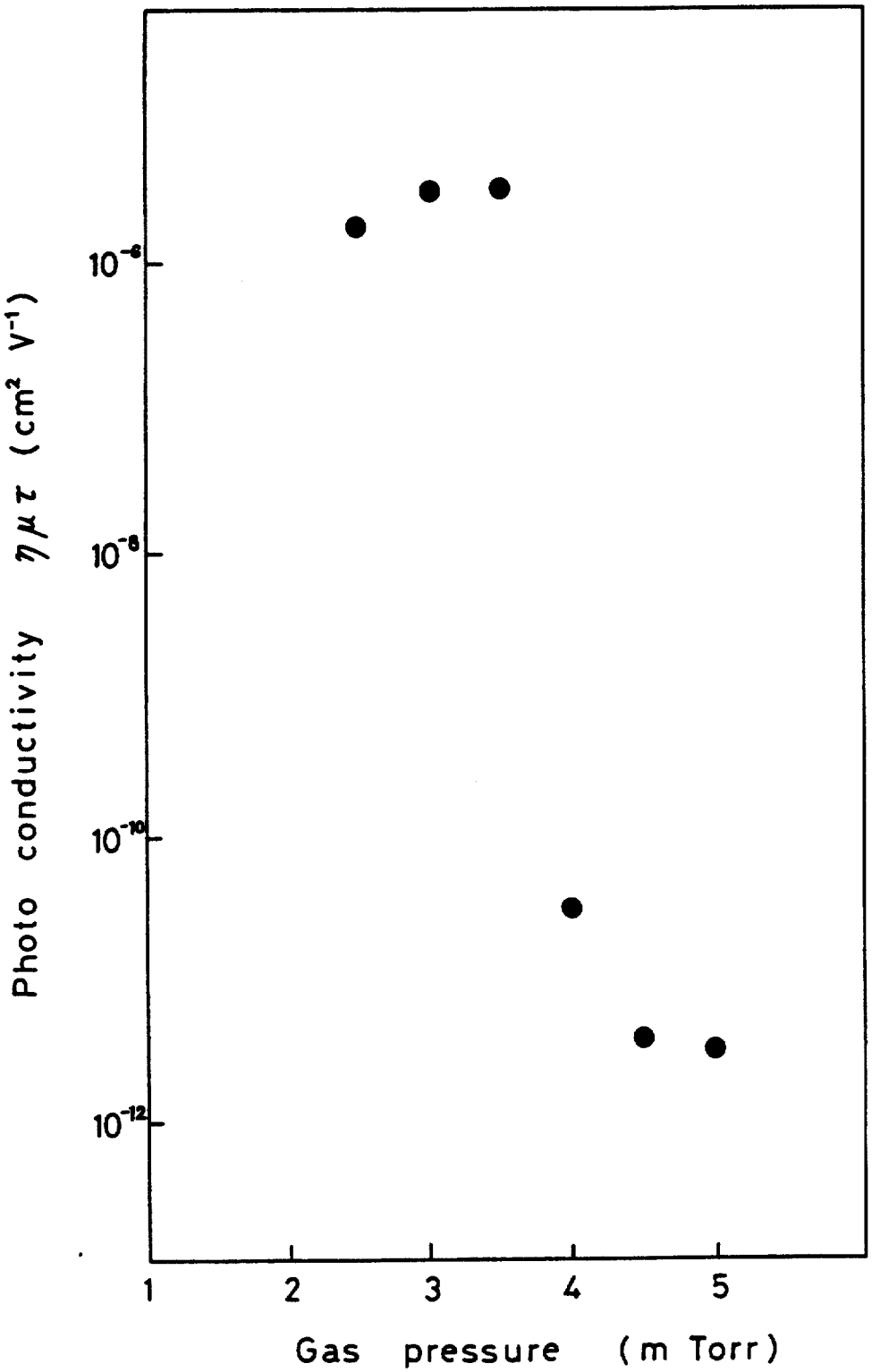

$SiH_4$ and $GeH_4$ as material gas are mixed up at specific rates of $SiH_4/(SiH_4+GeH_4)=0.88$ and $SiH_4/(SiH_4+GeH_4)=0.81$ respectively, and introduced into the specimen chamber with the mixed gas flow amount being at 120 sccm, while gas pressure in the specimen chamber is varied between 2–5 m Torr, thereby depositing a-SiGe layer. In this case, the substrate was not heated and microwave output was set to be 2.5 kw. A gas pressure dependence of the properties of a-SiGe layer in case that material gas ratio is represented by 0.88 as above-mentioned is shown in FIG. 2, and a gas pressure dependence of the properties of a-SiGe layer in case that material gas ratio is represented by 0.81 is shown in FIG. 4. Also, FIG. 2(A) and FIG. 4(A) are the relationship between hydrogen content and gas pressure, and FIG. 2(B) and FIG. 4(B) and FIG. 2(C) and FIG. 4(C) are the relationship between dark resistivity ($\rho d$) and photo conductivity ($\eta\mu\tau$) of the a-SiGe layer and gas pressure. The shown photoconductivity ($\eta\mu\tau$) is a result of a test made with a light source by a laser (830 nm). Also, the Ge content in the resultant a-SiGe layer is almost 45–61 atomic % with respect to Si.

As seen from FIG. 2 and FIG. 4, hydrogen content in the layer stars to vary at almost 3.5 m Torr, and similarly, dark resistivity ($\rho d$) and photo conductivity ($\eta\mu\tau$) vary. In detail, when gas pressure is almost 2.5–3.5 m torr, hydrogen content in the layer exceeds about 40 atomic %, and both of dark resistivity ($\rho d$) and photoconductivity ($\eta\mu\tau$) abruptly increase.

The improvement of photoconductivity ($\eta\mu\tau$) is considered due to the fact that addition of hydrogen at more than almost 40 atomic % causes a reduction of a dangling bond of Ge through coupling of Ge and H. However, from the tests made by the inventors, when hydrogen content in the layer exceeds almost 65 atomic %, optical band gap increases due to addition of hydrogen and leads to elimination of the effect caused by Ge addition, thereby deteriorating sensitivity. Hence, it is preferable that hydrogen content in a-SiGe layer is set in an extent of 40–65 atomic %.

Next, Ge addition in a-SiGe layer will be detailed. Addition of Ge in a-Si layer leads to an effect of reduction of optical bandgap in the layer and increase of absorption efficiency with respect to a longer wavelenth such as 780–830 nm, while creating a problem of lowering of dark resistivity ($\rho d$) and photoconductivity ($\eta\mu\tau$). Hence, it is critical to set Ge addition at an optimum value.

A mixing ratio of $SiH_4$ and $GeH_4$ as material gas is varied to change the Ge content of the film. In this case, material gas pressure was 2.5–3.5 m Torr to hold hydrogen content of the film to be 43–48 atomic %. Then, a relationship between Ge content of the formed film and photosensitivity to a laser at 780–830 nm (i.e., photoconductivity ($\eta\mu\tau$) with respect to 780–830 nm) was observed and it was found that when Ge amount with respect to Si is less than 5.3 atomic %, there has hardly seen an effect by Ge addition to thereby show a poor sensitivity. Also, when Ge amount is more than 150 atomic % with respect to Si amount, dark resistivity becomes very lower, which feature was not suitable for a photosensitive member. In other words, it is relevant that Ge content of a-SiGe layer is 5.3–150 atomic % with respect to Si (preferably 18–82 atomic %, more preferably 43–67 atomic %).

In the above-mentioned explanation, since hydrogen compounds of Si, Ge are used, only hydrogen is contained in the formed film. In case of use of halogen compounds of Si, Ge in view of the fact that halogen can give the same effect as obtained by hydrogen, it is preferable that a total content of halogen and/or hydrogen in a-SiGe layer is about 40–65 atomic %.

Next, a-Si layer will be detailed.

$SiH_4$ (120 sccm) as material gas is introduced into the specimen chamber 2 to deposit film on a substrate made of Al having no heating thereto, thereby depositing a-Si layer. In this case, microwave power was 2.5 kw and gas pressure was varied between 2–5 m Torr for this test. FIG. 3(A) shows hydrogen content of the resultant a-Si layer, and FIG. 3(B) and (C) show dark resistivity ($\rho d$) and photoconductivity ($\eta\mu\tau$) of the a-Si layer. The shown photo conductivity ($\eta\mu\tau$) was obtained with a 565 nm LED light source.

Figure 3:
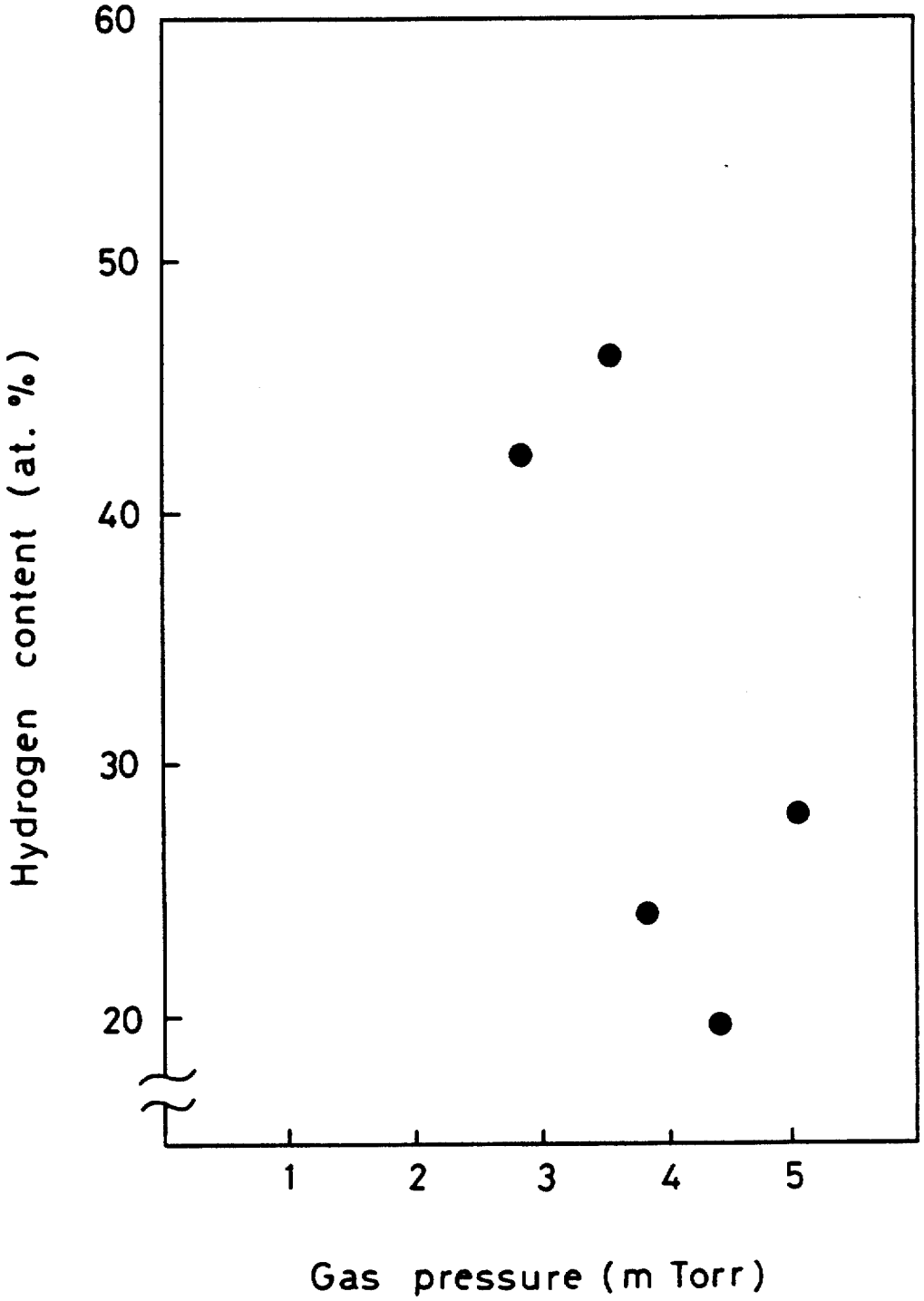
FIG. 3 (A)–(C) are explanatory views showing the relationship between material gas pressure upon the film deposition on of a-Si photosensitive layer, hydrogen content in the deposited photosensitive layer, and dark resistivity or photoconductivity of the deposited photosensitive layer, respectively.
Figure 3:
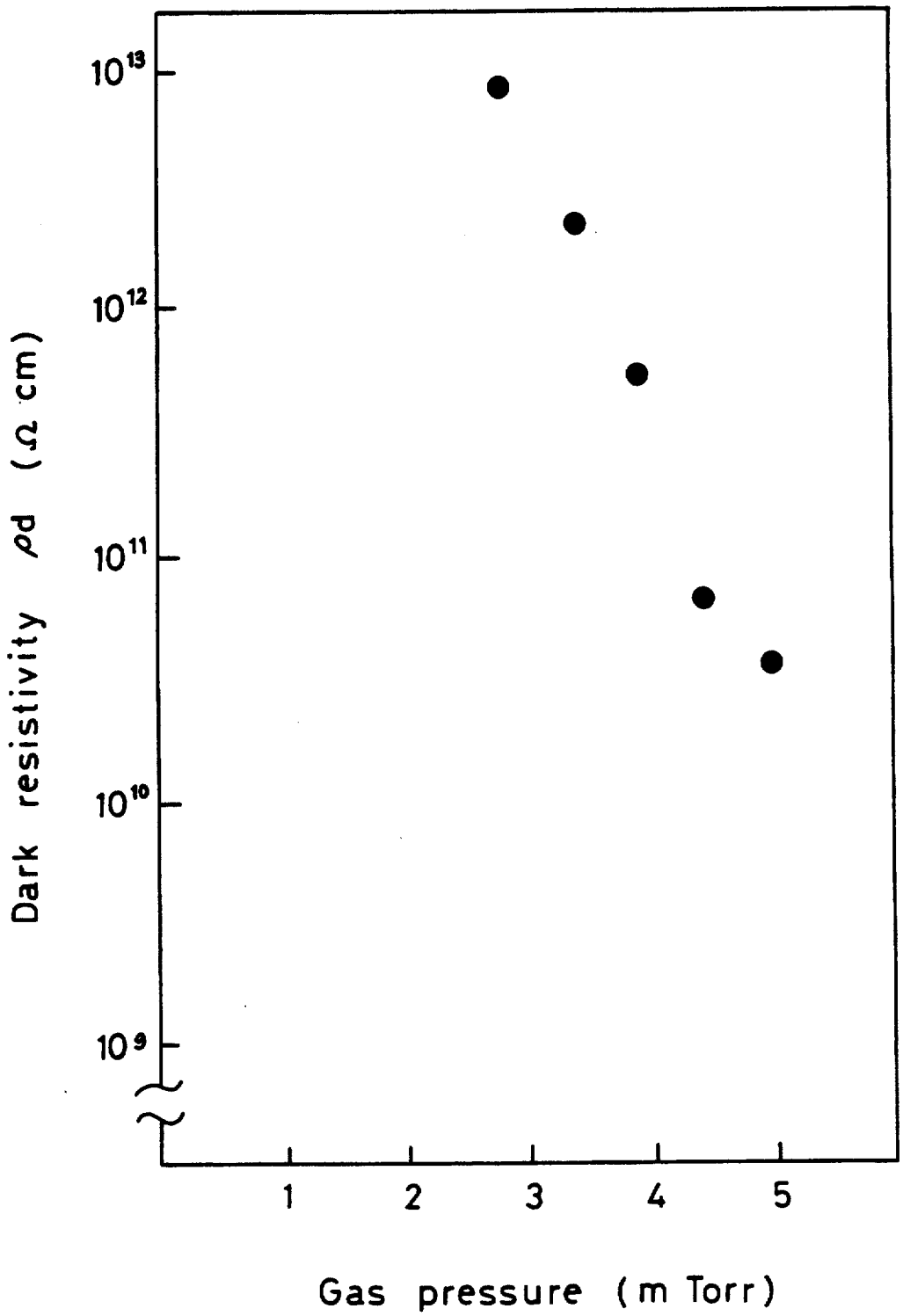
Figure 3:
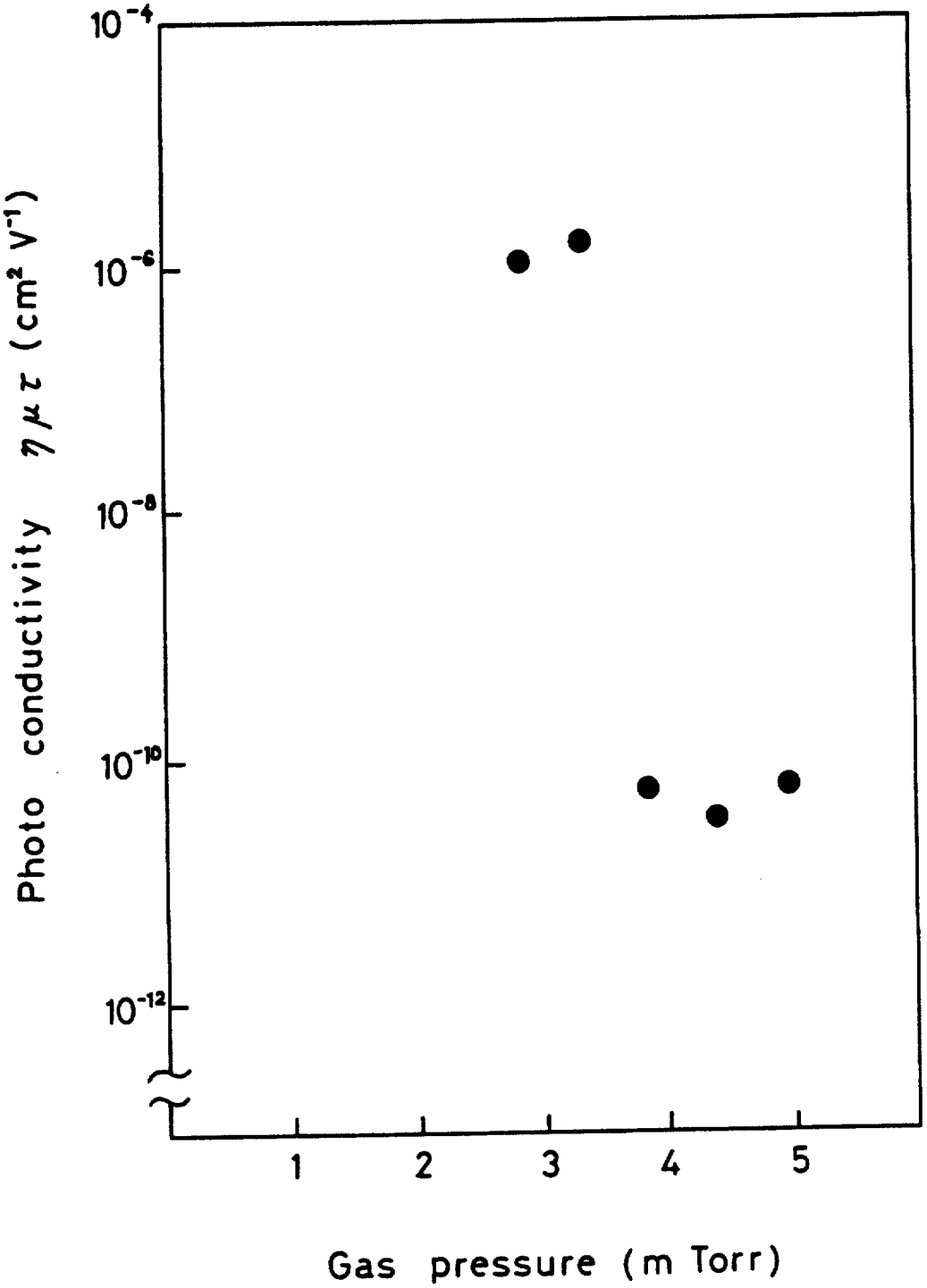

As seen from FIG. 3 (B) and (C), hydrogen content of the a-Si layer becomes more than 40 atomic % at almost 2–3.5 m Torr gas pressure, and similarly, dark resistivity ($\rho d$) becomes higher. In detail, when hydrogen content of the a-Si layer is less than 40 atomic %, dark resistivity ($\rho d$) becomes $10^{11}$ Ωcm at the most, but when hydrogen content exceeds 40 atomic %, dark resistivity ($\rho d$) becomes more than $10^{12}$ Ωcm. Resultantly, the a-Si photosensitive member containing hydrogen at more than 40 atomic % is quite superior in charge acceptance and dark decay characteristics. Also, as seen from FIG. 3(C), the a-Si photo- sensitive member can have a high photoconductivity ($\eta\mu\tau$) with respect to light around 565 nm. Hence, the a-Si layer of the present invention is superior in carrier transport property, so that the carriers generated by incident light in a-SiGe layer, which are induced to a-Si layer, can be transported effectively through a-Si to the surface or the substrate under the electric field.

The above-mentioned improvement of photoconductivity ($\eta\mu\tau$) is considered due to such fact that when hydrogen is contained at more than 40 atomic % in the layer, a dangling bond of Si atom in the film can be reduced. To be noted is that since a hydrogen compound of Si is used as material gas in this case, only hydrogen is contained in the deposited a-Si layer, and when halogen compound of Si is used as material gas, halogen is contained in a-Si layer so as to function similarly to hydrogen as referred to in the foregoing explanation of the a-SiGe layer, thereby improving a property of the a-Si layer.

As above-mentioned, when a-SiGe layer and a-Si layer are formed by use of a film deposition apparatus with ECR method and under such condition that the substrate is not heated and the microwave power is set to be higher such as at 2.5 kw, pressure of material gas is set to be in such a predetermined range as 2.5–3.5 m Torr for a-SiGe layer and 2–3.5 Torr for a-Si layer, so that the total of hydrogen content and halogen content of the layers can be set at almost 40–65 atomic %, thereby enabling to perform a favorable film formation with an improved dark resistivity ($\rho d$) and photoconductivity ($\eta\mu\tau$). Furthermore, when gas pressure is set to be at the above-mentioned value, the film can be formed with a favorable film deposition rate and gas usage efficiency in comparison with another gas pressure range wherein hydrogen content becomes less than 40 atomic %. Also, the film formation could be performed more quickly at 6–10 times in higher rate in comparison with the conventional apparatus by plasma CVD method which is generally used for film deposition apparatus for providing a photosensitive member of a-Si and a-SiGe. Also, in film formation through the film deposition apparatus by the ECR method there is no generation of polymeric powder as $(SiH_2)n$ to thereby have no deficiency in the resulting film due to adhesion of the powder onto the substrate of photosensitive member, so that the formed photosensitive member have good yield and high quality.

Formation of a-SiGe layer and a-Si layer can be realized by the above-mentioned process. Properties of the resultant a-SiGe layer and a-Si layer containing hydrogen and/or halogen at almost 40–65 atomic % could be summarized as follows.

(1) a-SiGe layer

The layer has a photosensitivity with respect to 780–830 nm (Ge addition effect) and when hydrogen and/or halogen content of the film is more than 40 atomic %, it presents an improved dark resistivity ($\rho d$) (almost $10^{11}$ Ωcm) and photoconductivity ($\eta\mu\tau$). Hence, an electrographic photosensitive member that is provided with a-SiGe layer laminated at a surface layer side in the photosensitive member can be obtained with having sufficient charge acceptance and dark decay characteristics. Such an electrophotosensitive member which is provided with a-SiGe layer, hitherto could not be realized due to a poor charge acceptance and dark decay characteristic from a lower dark resistivity provided by the conventional methods wherein content of hydrogen and/or halogen was limited to less than 40 atomic %.

For further improving charge acceptance and dark decay characteristic, it is preferable as aforesaid that a-SiGe layer is provided at the substrate side.

(2) a-Si layer

This layer when containing hydrogen and/or halogen at more than 40 atomic % has quite high dark resistivity ($\rho d$) at $10^{12}$ Ωcm without adding boron to thereby be superior in charge acceptance and dark decay characteristic. From tests made by the inventors, when boron is added, dark resistivity ($\rho d$) is made higher to almost $10^{14}$ Ωcm. Also, photoconductivity ($\eta\mu\tau$) was improved by containing hydrogen and/or halogen at more than 40 atomic % in the a-Si layer. This means that the containing of hydrogen and/or halogen at more than 40 atomic % in the layer improves transport property of the carriers. Also, addition of hydrogen and/or halogen makes the optical bandgap higher, so that a light absorption coefficient with respect to longer wavelength range such as at 780–830 nm becomes poor. This means that the feature prevents a carrier excitation of the incident light in wavelength range at 780–830 nm at a specific level between gaps state. Such an excited carrier cannot function as the carrier which can transport through a-Si and cancel the charge held on the surface of the photosensitive member as in the conventional a-Si layer containing hydrogen and/or halogen at less than 40 atomic %, so that there is provided transparency with respect to a light in the wavelength range at 780–830 nm.

According to the above-mentioned features, a photosensitive member of the invention is obtained wherein a-Si layer and a-SiGe layer, respectively containing hydrogen and/or halogen at more than 40 atomic % are laminated in such order that a-SiGe layer is laid at the surface layer side or at the substrate side for further improving charge acceptance and dark decay characteristic. In either feature of lamination order, a-SiGe layer functions as a charge generating layer and a-Si layer as charge-acceptance and charge-transporting layer.

FIG. 1 is a sectional view showing a photosensitive member provided at the substrate side with a-SiGe layer of the practical embodiment of the invention, wherein an intermediate layer 22, photoconductive layer 23, surface layer 24 are laminated in this order on a conductive substrate 21 made of Al and the like. Characteristic of the invention is in the photoconductive layer 23 which comprises a-SiGe layer **23*a* located nearer the substrate 21 and a-Si layer 23*b* above the a-SiGe layer 23*a***.

EXAMPLE 1

A cylindrical conductive substrate made of Al is mounted in the specimen chamber 2, and $SiH_4$ gas of 120 sccm and $B_2H_6$ gas of 20 sccm (diluted by $H_2$ to 3000 ppm) are fed into the specimen chamber 2, so that an intermediate layer comprising a-Si of 2.5 μm thickness and being much doped with boron is deposited by ECR method on the conductive substrate under the condition of gas pressure 2.8 m Torr and microwave power 2.5 kw.

Then, into the specimen chamber 2 is introduced $SiH_4$ gas of 120 sccm and $B_2H_6$ gas of 5 sccm (diluted by $H_2$ to 30 ppm), so that a-Si layer of 25 μm thickness is deposited on the intermediate layer by ECR method under the condition of gas pressure of 2.8 m Torr and microwave power 2.5 kw. Hydrogen content in the a-Si layer was 48 atomic %.

Furthermore, into the specimen chamber 2 is introduced $SiH_4$ gas of 105 sccm, $B_2H_6$ gas of 12.5 sccm (diluted by $H_2$ to 30 ppm) and $GeH_4$ of 15 sccm, so that a-SiGe layer of 5 μm thickness is deposited on the a-Si layer by ECR method under the condition of gas pressure 2.8 m Torr and microwave power 2.5 kw. Hydrogen content in the a-SiGe layer was 46 atomic %, and Ge content was 54 atomic % with respect to Si atom. Further, into the specimen chamber 2 is introduced $SiH_4$ gas of 30 sccm and $CH_4$ gas of 1000 sccm, so that a surface layer comprising a-SiC of 0.3 μm thickness is deposited on the a-SiGe layer by ECR method under the condition of gas pressure 3.0 m Torr and microwave power 2.5 kw, whereby a positive charge electrophotographic photosensitive member was formed.

In the production process of the electrophotographic photosensitive member, there is no generation of polymeric powder as $(SiH_2)n$, and film deposition rate and gas usage efficiency have a considerable higher value at 6–10 times in comparison with those in the conventional art. Additionally, the electrophotographic photosensitive member when practically mounted to a commercially available positive charge laser printer (wavelength of light source: 830 nm) showed an excellent charge acceptance and dark decay characteristics and provided a favorable image formation.

It is needless to say that the Al cylindrical substrate is not heated in this production process.

EXAMPLE 2

Under the same production conditions as that used in the example 1 except that gas pressure is changed to 2.8, 3.4, 3.8, 4.4, 5.0 m Torr upon deposition of a-Si layer and to 2.4, 2.8, 3.3, 3.8, 4.3, 4.8 upon deposition of a-SiGe layer, thirty electro-photographic photosensitive members were made. Estimation regarding charge acceptance and dark decay characteristics and image property of the obtained photosensitive member, and the results of estimation are shown in the Table 1. As shown, when gas pressure is 2.4–3.3 m Torr upon deposition of a-SiGe layer and 2.8–3.4 m Torr upon deposition of a-Si layer, an excellent electrophotographic photosensitive member with a favorable charge acceptance and dark decay characteristics and image property can be obtained. As seen from FIG. 2(A) and FIG. 3(A), the excellent electrographic photosensitive member is obtained when hydrogen content in a-Si layer and a-SiGe layer respectively is more than 40 atomic %. In this case, Ge content is 45–61 atomic % with respect to Si atom.

TABLE 1

| $P_2$ (m Torr) | | $P_1$ (m Torr) 2.4 | 2.8 | 3.3 | 3.8 | 4.3 | 4.8 |
|---|---|---|---|---|---|---|---|
| 2.8 | A | | | | | | × |
| | B | | | | × | × | × |
| 3.4 | A | | | | | | × |
| | B | | | | × | × | × |
| 3.8 | A | | | | | Δ | × |
| | B | Δ | | | × | × | × |
| 4.4 | A | × | × | × | × | × | × |
| | B | × | × | × | × | × | × |
| 5.0 | A | × | × | × | × | × | × |
| | B | Δ | | | × | × | × |

$P_1$: a gas pressure upon deposition of a-SiGe layer
$P_2$: a gas pressure upon deposition of a-Si layer
A: charge acceptance and dark decay characteristics
B: image property ← ← Δ ← ×
good ← no good

EXAMPLE 3

Under the same conditions used in the example 1 except that $PH_3$ was used for doping P (N type impurity) to photoconductive layer and intermediate layer in place of the doping gas $B_2H_6$, and gas pressure upon deposition of a-SiGe layer was 3.0 m Torr, a negative charge electrophotographic photosensitive member was made. To be noted is that a flow rate of $PH_3$ gas was 10 sccm (diluted by $H_2$ to 3000 ppm), 1 sccm (diluted by $H_2$ to 30 ppm) and 12 sccm (diluted by $H_2$ to 30 ppm) upon deposition of the intermediate layer, a-Si layer, and a-SiGe layer respectively. The resultant electrophotographic photosensitive member when practically mounted to a negative charge laser printer (wavelength of light source: 830 nm) showed an excellent charge acceptance and dark decay characteristics and provided a favorable image formation.

EXAMPLE 4

An electrophotographic photosensitive member was made under the same condition used in the example 1 except that upon deposition of a-SiGe layer a flow rate of $GeH_4$ gas is continuously increased to 0–15 sccm by controlling of a flow rate of control apparatus for $GeH_4$, and simultaneously, a flow rate of $SiH_4$ gas is controlled by a flow rate control apparatus to thereby be continuously reduced to 120–105 sccm, so that a total flow rate of $SiH_4$ and $GeH_4$ is controlled and always 120 sccm, whereby the resultant a-SiGe contains much Ge at its surface side which is near side of the surface layer. Measurement of specific property of the resultant electrographic photosensitive member showed a favorable property particularly of less residual potential. Also, the electrophotographic photosensitive member when mounted to a positive charge laser printer provided a favourable image formation.

Figure 6:
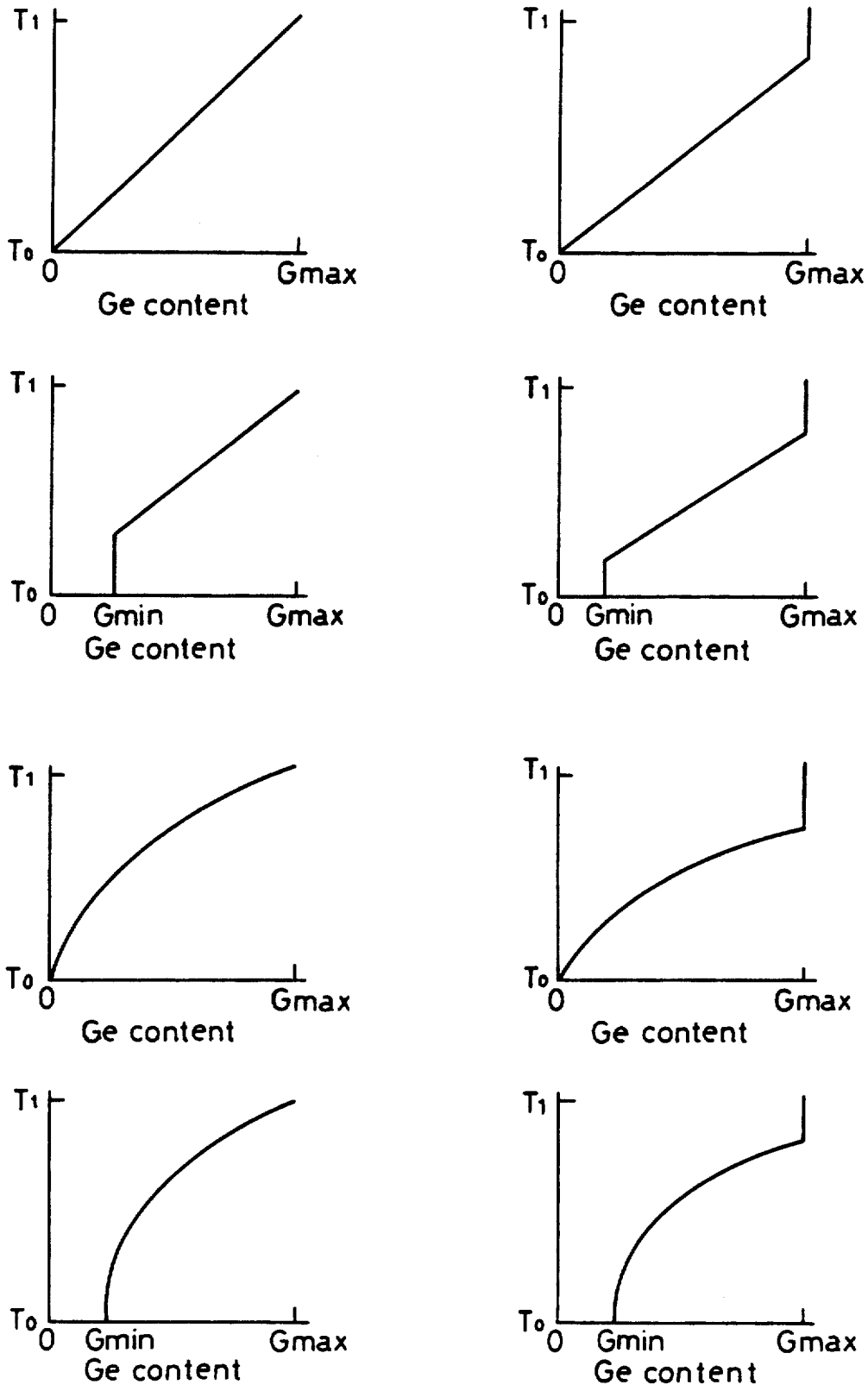
FIG. 6 is an explanatory view showing a distribution of Ge content in the film-thickness direction in a-SiGe photosensitive layer when deposited at an upper side.

It is needless to say that in the photosensitive member a layer containing Ge contains hydrogen at more than 40 atomic % over all of specific areas of the layer. There are many distributions of Ge atoms in the a-SiGe layer as shown in FIG. 6 and each distribution had much effect on lowering of residual potential. To be noted is that $T_0$ in FIG. 6 represents a boader between the a-SiGe layer and a-Si layer and $T_1$ represents that to the surface covering layer. Also, Gmax and Gmin each represent maximum value and minimum value respectively of a ratio of Ge content with respect to Si atom. In all cases shown in FIG. 6, it is confirmed that Ge atom is continuously distributed and is distributed much at the surface layer side. In lamination of a-Si layer having a large optical band gap and a-SiGe layer having a lower optical band gap with containing hydrogen at more than 40 atomic % in the film as provided in the present invention, such a good property as to be lower residual potential is guessed to have caused by that the distribution of Ge atoms in the a-SiGe layer as shown in FIG. 6 could mitigate an electrical and mechanical mismatch between the a-Si layer and the a-SiGe layer.

EXAMPLE 5

Similarly to example 1, a-Si intermediate layer of 2.5 μm thickness and being doped with much boron was deposited on the conductive support member of Al. Then, $SiH_4$ gas of 97 sccm, $GeH_4$ gas of 23 sccm, and $B_2H_6$ gas of 12.5 sccm (diluted by $H_2$ to 30 ppm) are fed into the specimen chamber 2, so that a-SiGe layer of 5 μm thickness is deposited by ECR method on the intermediate layer under the condition of gas pressure 3.2 m Torr and microwave power 2.5 kw. Then, into the specimen chamber 2 is introuded $SiH_4$ gas of 120 sccm and $B_2H_6$ gas of 5 sccm (diluted by $H_2$ to 30 ppm), so that a-Si layer of 25 μm thickness is deposited on the a-SiGe layer under the condition of gas pressure 2.8 m torr and microwave power 2.5 kw. Furthermore, as in the example 1, a surface layer comprising a-SiC of 0.3 μm thickness is deposited, so that a negative charge electrophotographic photosensitive member was formed. Hydrogen content in the a-SiGe layer of the formed electrophotographic photosensitive member was 46 atomic % and Ge content was 61 atomic % with respect to Si atom. Also, hydrogen content in the a-Si layer was 48 atomic %. When image formation was performed by the obtained electrophotographic photosensitive member with a light source of 830 nm laser, it showed a higher charge acceptance and dark decay characteristic and provided a higher quality image formation compared with the case that a-SiGe layer is laid at the upper side. It is needless to say that the conductive support member of Al is not heated.

EXAMPLE 6

Under the same production conditions as that used in the example 5 except that gas pressure is changed to 2.8, 3.4, 3.8, 4.4, 5.0 m torr upon deposition of a-Si layer and to 2.4, 2.8, 3.3, 3.8, 4.3, 4.8 upon deposition of a-SiGe layer, thirty electrophotographic photosensitive members were made. Estimation regarding charge acceptance and dark decay characteristics and image property of the obtained photosensitive members, and the results of estimation are shown in the Table 2. As shown, when gas pressure is 2.4–3.3 m Torr upon deposition of a-SiGe layer and 2.8–3.4 m Torr upon deposition of a-Si layer, an excellent electrophotographic photosensitive member with a favorable charge acceptance and dark decay characteristics and image property can be obtained. As seen from FIGS. 3(A), 4(A), the excellent electrographic photosensitive member is obtained when hydrogen content in a-Si layer and a-SiGe layer respectively is 40–65 atomic %., and Ge content in this case is 45–64 atomic % with respect to Si atom.

TABLE 2

| $P_2$ (m Torr) | | $P_1$ (m Torr) 2.4 | 2.8 | 3.3 | 3.8 | 4.3 | 4.8 |
|---|---|---|---|---|---|---|---|
| 2.8 | A | | | | | | × |
| | B | | | | × | × | × |
| 3.4 | A | | | | | | × |
| | B | | | | × | × | × |
| 3.8 | A | | | | | Δ | × |
| | B | Δ | | | × | × | × |
| 4.4 | A | × | × | × | × | × | × |
| | B | × | × | × | × | × | × |
| 5.0 | A | × | × | × | × | × | × |
| | B | Δ | | | × | × | × |

$P_1$: a gas pressure upon deposition of a-SiGe layer
$P_2$: a gas pressure upon deposition of a-Si layer
A: charge acceptance and dark decay characteristics
B: image property ← ← Δ ← ×
good ← no good

EXAMPLE 7

An electrophotographic photosensitive member was made under the same condition used in example 5 except that upon deposition of a-SiGe layer a flow rate of $SiH_4$ gas is continuously varied to 97–120 sccm and simultaneously that of $GeH_4$ gas to 23–0 sccm, with keeping always a total flow rate of $SiH_4$ and $GeH_4$ to be 120 sccm, so that the resultant a-SiGe layer has less Ge content at its upper part. Measurement of specific property of the resultant electrophotographic photosensitive member showed a favourable property particularly of less residual potential. Also, the electrophotographic photosensitive member when mounted to a negative charge laser printer provided a favourable image formation.

Figure 7:
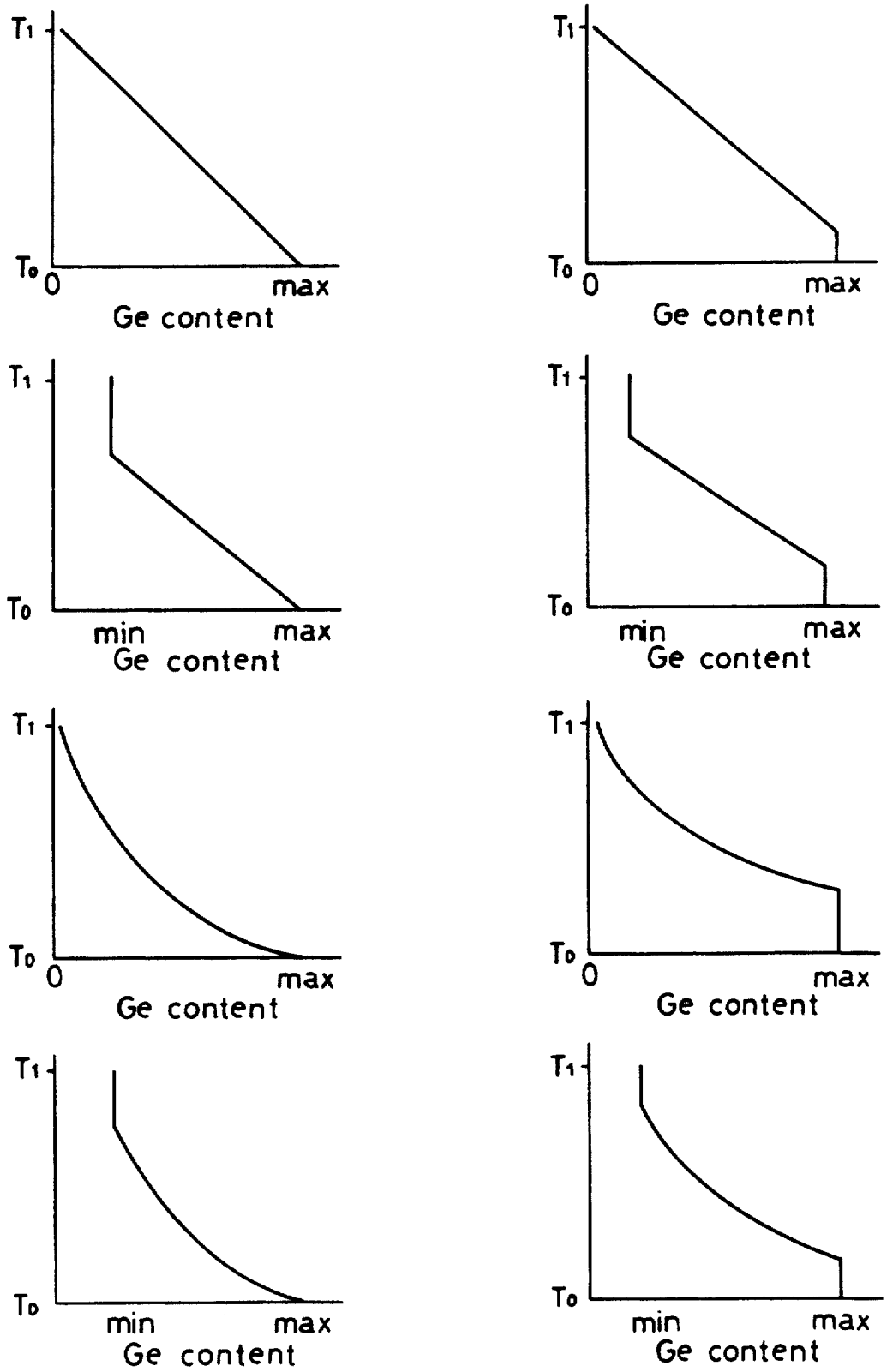
FIG. 7 is an explanatory view showing a distribution of Ge content in the film-thickness direction in a-SiGe photosensitive layer when deposited at lower side.

FIG. 7 shows variation of Ge content in the deposited a-SiGe layer. In the drawing, $T_0$ is the substrate side and $T_1$ is the a-Si layer side. As shown, Ge amount contained in the deposited a-SiGe layer reduces gradually from the maximum point at the substrate side corresponding to variation of material gas flow rate. To be noted is that the material gas flow rate is adpated to change in such range that Ge content in the a-SiGe layer becomes 5.3–150 atomic % with respect to Si.

When image formation was performed by the photosensitive member with Ge amount in the a-SiGe layer being gradually varied, it provided a more favourable higher quality image formation in comparison with that obtained by the photosensitive member formed in the example 5. This is considered due to such fact that since Ge content gradually varies around the border between the a-SiGe layer and the a-Si layer, an electrical and constitutional mismatching at the border of the two layers can be mitigated as referred to in the example 4. In other words, in case that Ge content changes abruptly at the border between the a-SiGe layer and the a-Si layer (i.e., the case shown by the example 5), trap and the like which captures the photo generated carriers occurs at that border due to a difference of optical bandgap and specific structures between the two lasers, so that the photo generated carriers which are captured in the trap and the like result in the residual potential, thereby deteriorating the resultant image. By contrast, the feature as aforesaid gradually changes Ge content, so that those mismatching are mitigated so as to reduce the amount of residual potential, thereby enabling to favorably perform an image formation process.

The above-mentioned example sets a formed photosensitive member to be in p type by mixing $B_2H_6$ with material gas. For setting photosensitive member to be p type, boron compounds such as $BCl_3$, $BH_3$ and the like, or compounds or aluminium, gallium, or indium other than $B_2H_6$ may be employed.

EXAMPLE 8

Under the same conditions used in the example 5 except that $PH_3$ was used for doping P (N type impurity) to photoconductive layer and intermediate layer in place of the doping gas $B_2H_6$, a positive charge electrophotographic photosensitive member was made. To be noted is that a flow amount of $PH_3$ gas was 10 sccm (diluted by $H_2$ to 3000 ppm), 1.2 sccm (diluted by $H_2$ to 30 ppm) and 1.0 sccm (diluted by $H_2$ to 30 ppm) upon deposition of the intermediate layer, a-SiGe layer, and a-Si layer, respectively. The resultant electrophotographic photosensitive member when practcially mounted to a positive charge laser printer showed an excellent charge acceptance and dark decay characteristics and provided a favorable image formation.

EXAMPLE 9

Under the same conditions used in the example 1 except that $B_2H_6$ gas is not introduced, i.e., doping gas is not used, an electrophotographic photosensitive member was made. The resultant electrophotographic photosensitive member when mounted to a negative charge laser printer provided a favorable image formation, which is inferior to that of example 1.

EXAMPLE 10

Under the same conditions used in the example 5 except that $B_2H_6$ gas is not introduced, i.e., a doping gas is not used, an electrophotographic photosensitive member was made. The resultant electrophotographic photosensitive member when mounted to a positive charge laser printer provided a favourable image formation, which is inferior to that of example 5.

What is claimed is:

1. A photosensitive member for electrophotography comprising a conductive substrate and a photoconductive layer; said photoconductive layer comprising two amorphous layers, one of said two amorphous layers being composed of an amorphous silicon containing a member selected from the group consisting of hydrogen, halogen and mixtures thereof at a range of from greater than 40 to about 65 atomic %, and the other of said two amorphous layers being composed of an amorphous silicon germanium containing a member selected from the group consisting of hydrogen, halogen and mixtures thereof at a range of from greater than 40 to about 65 atomic %.

2. The photosensitive member according to claim 1, wherein the amorphous layer composed of amorphous silicon is deposited utilizing an electron cyclotron resonance method.

3. The photosensitive member according to claim 1, wherein the amorphous layer composed of amorphous silicon germanium is deposited utilizing an electron cyclotron resonance method.

4. The photosensitive member according to claim 1, wherein at least one of said amorphous silicon and said amorphous silicon germanium contains hydrogen at 43-55 atomic %.

5. The photosensitive member according to claim 1, wherein said amorphous silicon germanium contains germanium at 5.3-150 atomic %, based on Si.

6. The photosensitive member according to claim 5, wherein said amorphous silicon germanium contains germanium at 18-82 atomic %, based on Si.

7. The photosensitive member according to claim 6, wherein said amorphous silicon germanium contains germanium at 43-67 atomic %, based on Si.

8. The photosensitive member according to claim 1, wherein the layer of amorphous silicon as lower side and the layer of amorphous silicon germanium as upper side are laminated in this order on said conductive substrate.

9. The photosensitive member according to claim 1, wherein the layer of amorphous silicon germanium as lower side and the layer of amorphous silicon as upper side are laminated in this order on said conductive substrate.

10. The photosensitive member according to claim 8, wherein the germanium content in the amorphous silicon germanium gradually reduces toward the layer of amorphous silicon.

11. The photosensitive member according to claim 9, wherein the germanium content in the amorphous silicon germanium gradually reduces toward the layer of amorphous silicon.

12. The photosensitive member according to claim 1, further comprising an intermediate layer between said conductive substrate and the photoconductive layer.

13. The photosensitive member according to claim 6, wherein said photoconductive layer has a free surface, and further comprising a surface layer over said free surface of the photoconductive layer.

14. The photosensitive member according to claim 1, wherein said conductive substrate comprises an aluminum plate.

* * * * *